United States Patent [19]

Tesch

[11] Patent Number: 4,917,943

[45] Date of Patent: Apr. 17, 1990

[54] FIBER CONTAINING AGGREGATE AND PROCESS FOR ITS PREPARATION

[76] Inventor: Günter Tesch, Avenue Jean-Marie-Musy 15, CH-1700 Fribourg, Switzerland

[21] Appl. No.: 143,028

[22] Filed: Jan. 12, 1988

[30] Foreign Application Priority Data

| | | | |
|---|---|---|---|
| Jan. 12, 1987 | [DE] | Fed. Rep. of Germany | 3700680 |
| Mar. 16, 1987 | [CH] | Switzerland | 00969/87 |
| Aug. 17, 1987 | [CH] | Switzerland | 03157/87 |

[51] Int. Cl.[4] ..... D02G 3/00

[52] U.S. Cl. ..... 428/288; 428/222; 428/227; 428/240; 428/244; 428/296; 428/357; 428/360; 428/362; 428/369; 428/370; 428/372; 428/402

[58] Field of Search ..... 428/357, 359, 364, 372, 428/402, 369, 371, 370, 296, 288, 222, 227, 360, 362, 240, 244, 400

[56] References Cited

U.S. PATENT DOCUMENTS

| | | | |
|---|---|---|---|
| 3,717,532 | 2/1973 | Kamp | 428/359 |
| 3,892,909 | 7/1975 | Miller | 428/371 |
| 4,065,599 | 12/1977 | Nishiumi et al. | 428/402 |
| 4,100,009 | 7/1978 | Nakajima et al. | 428/296 X |
| 4,131,704 | 12/1978 | Erickson | 428/296 |
| 4,157,275 | 6/1979 | Hollander | 428/372 |
| 4,237,180 | 12/1980 | Jaskowski | 428/299 |
| 4,413,030 | 11/1983 | Tesch | 428/85 |
| 4,481,247 | 11/1984 | Tesch | 428/234 |
| 4,540,625 | 9/1985 | Sherwood | 428/372 |
| 4,618,531 | 10/1986 | Marcus | 428/369 |
| 4,783,364 | 11/1988 | Ilan | 428/369 |

*Primary Examiner*—Lorraine T. Kendell

*Attorney, Agent, or Firm*—Bacon & Thomas

[57] ABSTRACT

A fiber containing aggregate, for example, a filler material for covers or pillows, for cushioning or as a filter is described, together with a process for its preparation.

In order to provide an aggregate wherein the fibers are located and distributed three-dimensionally in the manner desired, and, if so desired, remain in such a distribution and which has improved properties in particular as a filler material, it is proposed to place an assembly of spherically entangled fibers and/or filaments into a form desired and to bond the fiber balls to each other.

The fiber balls are joined together in particular by means of binder fibers, which may consist of, for example, melting fibers, soluble fibers or adhesive fibers. Melting fibers have a melt-on temperature which is lower than the melt-on temperature of other fibers of the aggregate and are activated by the application of heat.

The fiber balls may be joined together by means of binder fibers located in the individual fiber balls and/or additional binder fibers placed between the individual fiber balls. Other materials may also be placed both into the fiber balls and between them.

9 Claims, No Drawings

FIBER CONTAINING AGGREGATE AND PROCESS FOR ITS PREPARATION

The invention relates to a fiber containing aggregate, for example, as a filler material of covers or pillows, as a cushioning material or as filters, and a process for its preparation.

Fiber containing aggregates are used for example as filler materials for covers or pillows, as cushioning materials or as filters. The aggregates usually are fiber fleeces. They may be strengthened by a needle fleece process wherein needles partially seize individual fibers and align them in the fleece.

Fiber fleeces of this type are usually prepared by laying down staple fibers by means of a fiber card to form a web. It is possible with the use of different successive cards to place different fibers over the thickness of the web and it is also possible to lay down different fibers simultaneously on the same card.

However, the web-like product has a uniform thickness due to the mode of preparation, which may be varied at the most by placing over parts of the surface different webs over each other. The product must therefore be considered essentially two-dimensional, although it does have a certain thickness.

A known, fiber containing aggregate thus cannot be shaped into an arbitrary three-dimensional body. Furthermore, it is not possible to arrange different fibers in an arbitrary three-dimensional mixture.

It is the object of the invention to provide an aggregate of the aforementioned generic type, in which the fibers are distributed and arranged in a desired manner and remain so—if so desired—and which has improved properties in particular as a filler material.

The object is attained by the invention. According to the invention, the aggregate consists of fiber balls consisting of spherically tangled fibers, wherein the individual fiber balls are connected with each other. The fiber balls are therefore in contrast to known flat fiber fleeces, which are already used as aggregates for covers, pillows or cushioning materials, prepared individually as individualized fiber aggregates and then laid down for example flat—in one or more layers—or in an arbitrary spatial formation, for example in a mold, and joined together in a preferably single piece flat or spatial shape.

Such fiber balls are known for example from EP-A-0 203 469. The fiber balls known from this reference may be used for example as a loose filler or cushioning material. These fiber balls consist of helically curled and mutually entangled polyester fibers with a length of approximately 10 to 60 mm and with diameters between 1 and 15 mm. The fiber balls are elastic, whereby they essentially recover after compression (degree of recovery of 80%) even after a longer period of time. The fiber balls have mutual cohesions of less than 6 Newton, preferably 4.5 Newton or less (according to a measuring method described therein).

Due to these low cohesion values, the fiber balls shift very easily within a filling, especially if this filling is used as a head cushion or a bed cover. If the sleeping person is resting with his head on a cushion filled with such fiber balls, the cushion is pressured through very easily. When a bed covering filled with such balls is shaken up, the fiber balls shift in a manner similar to down, and accumulate in a corner or at an edge. In order to prevent this at least partially, the fiber balls must have a relatively high density in the cushion, which in turn renders them rather heavy. The cushions thereupon lose their "softness," which is sensed as disagreeable by many. Bed covers must correspondingly be filled with more fiber balls, or be better quilted.

Spherical fiber aggregates are also known from EP-A-0 013 427, in which fibers are wound into fiber balls. These fiber balls have diameters of up to 50 mm. The fibers used therein have a length of at least 15 mm, preferably between 40 and 120 mm, and a density of between 0.1 and 0.1 g/cm$^3$. The fibers may be natural fibers, for example cotton or wool fibers, animal hairs or the like, or synthetic fibers, for example, polyamide, polyester, polypropylene fibers or the like, or a mixture thereof. The fibers in particular may be curled fibers, for example, curled synthetic fibers. Such fibers have been used heretofore essentially for flat textile fabrics, in particular for the production of carpets, clothing materials, blankets, decorative materials or textile coverings. In the process, the fiber balls are needled together as flat formations and/or with a support layer. They are, however, strongly compressed by this method, so that such flat formations are very hard and cannot be used, for example, as head cushions. The fiber balls described in EP-A-0 013 427 are suitable as filler materials if the individual balls are bonded by means of a binder, so that the individual balls do not disintegrate.

Both types of known fiber balls are very difficult, compared to a fiber fleece, to distribute uniformly, if they are to be inserted into a covering, or if they are to be spread as an elastic cushioning material over a larger surface in a uniform thickness.

According to a preferred embodiment, the fiber balls are joined to each other according to the invention by means of binder fibers. These may be fibers of the individual fiber balls, connected with fibers of another fiber ball. This connection between two fibers may be effected by the adhesive bonding of the two fibers at their intersections.

The fibers to be joined together preferably are so-called binder fibers. These binder fibers may be present in addition to the fiber balls in the aggregate, but in keeping with an advantageous embodiment of the invention, the fiber balls themselves contain both binder fibers and other fibers. However, all of the fibers of the individual balls may also be binder fibers.

The binder fibers consist of preferentially melting fibers with a melt-on temperature lower than the melt-on temperatures of the other fibers of the filling. These melting fibers may be caused to begin to melt by the application of heat, whereupon they become adhesively bonded to the adjacent fibers, both melting or other fibers.

The binder fibers may also consist of thermoplastic fibers, in particular, water soluble fibers, for example, polyvinylalcohol fibers, which are activated by surface solution and are entering bonds with other fibers of the total aggregate. The binder fibers may also be adhesive fibers.

According to one embodiment, the binder fibers are more rigid and/or coarser than the other fibers. The binder fibers, in particular if they are a component of fiber balls, are then not parallel to the other fibers of the balls, but may even protrude from the balls in a barb-like manner. It is in particular possible to connect the fiber balls with each other only by means of the protruding binder fibers, whereby the flat fabric formed by the fiber balls becomes very flexible and drapeable.

When used as a filling for bed covers, it adapts very well to the shape of the body of the person to be covered.

If the binder fibers are thermoplastic fibers, in particular water soluble fibers, for example, polyvinylalcohol fibers, the joints may be released for example after the quilting of a cover, by washing the finished bed covering.

If the connections between the fiber balls of one plane are different from the connections between fiber balls of two planes located upon each other, the bond between the planes may for example be released, while the joining of the fiber balls of one plane is preserved. It is then also possible for the user to make the aggregate thinner than in its original state. The same is true for spatially different bonds between the individual fiber balls of an aggregate.

This is made possible for example because the fiber balls of a flat formation are joined together with those of one or several planes located upon each other by binder fibers contained in the balls themselves, either because the ends of said binder fibers are protruding from the balls, or because the fiber balls have a sheathing of melting binder fibers.

A similarly configured flat formation may then be placed over it, with a layer of individual meltable binder fibers being located between then, whereby the two flat formations are bonded together. If only these individual binder fibers are water soluable, then one flat formation may be separated from the other by washing, without the disintegration of the formations as such.

However, the individual fiber balls may also be joined together by individual additional binder fibers, which may be placed in a net like manner over and/or under a layer of fiber balls and which then adhere after surface melting.

The joints between the individual fibers of different fiber balls may also be loose enough to be released by beating with a beater brush.

Mixtures of fiber balls with or without binder fibers, i.e., melting, soluble or adhesive fibers, may also be present, so that certain balls are bonded only passively.

The mutual connecting of the individually prepared fiber balls renders the aggregate containing the balls rollable, bendable and foldable, and also capable of being upset and compressed. An aggregate of this type may also be manipulated variously without a casing. In particular, such a configuration is suitable for the transport of fiber balls. Furthermore, within a bed covering without quilting, the aggregate may be made thicker by rolling or folding one end, so that in the sensitive foot area, for example, more fiber balls may be provided than in the area toward the head. This may be accomplished by the user himself. If the rolled or folded end is stitched, it remains so even after the cover is shaken. This cannot be accomplished in such a simple manner by the user with down or the known fiber balls.

As mentioned above, the aggregate may be placed in a case. The latter may consist for example of a fabric case, such as those used for bed covers or pillows. As the insert, i.e., the aggregate according to the invention, is prepared before hand, it may have and retain any shape or thickness desired. Such an insert may have different fibers at the foot end and/or may be thicker there, than at the head end. Heretofore, such differences in thickness were obtained by quilting, but this results in thermal bridges in the area of the stitchings. Such disadvantages are not encountered with the aggregate according to the invention. The inserts may also be connected with the inside of the case. These connections may be obtained by means of the binder fibers of the fiber balls.

The fiber balls may further be placed onto a support and joined to it. In the case of the floor covering of the aforecited EP-A-0 013 427, the fiber balls are strongly compressed by the needling process. This is not true for an aggregate adhesively bonded according to the invention to a support.

Such a casing or support may consist of a fabric or a perforated sheet preferably of a plastic. Such a sheet may be for example a slit plastic sheet shrunk into a net, such as that marketed by the XIRO AG, Co., CH-3185 Schmitten, Switzerland, under the trademark of "XIRONET." Nets of this type become adhesive under the effect of heat, so that the fiber balls may be bonded to the net by the application of heat. It is then not necessary for the fiber balls themselves to be adhesive or meltable; i.e., no surface melting is required. Such a net may also be activated by the application of pressure.

According to one embodiment, the fiber balls adjacent to the casing or the support are connected with the latter by means of binder fibers only.

The fiber balls are, for example, adhesively bonded, sewed, needled, or stitched to the casing or support.

By means of the configuration according to the invention, the aggregate itself may form a case. Loose fiber balls, individual fibers, fiber fleece and preferably a material containing no fibers may be filled into said case. The latter material may consist of down or feathers or solid particles, such as activated carbon particles or powder, ion exchangers, sand, seed grains, fertilizer or the like.

The aggregate according to the invention consists of at least one layer of fiber balls. These fiber balls must be in contact with each other in order to be bonded. The layer must therefore be relatively closed.

Fiber balls of different diameters, colors or with different fibers may be used. A great variety of the configuration of the aggregate desired may thereby be obtained. No such variety may be achieved with the known fiber fleeces or the like.

The fiber balls of the aggregate may be filled in particular with a grainy material. But even between the balls, another material may be placed, in particular a grainy material. This may involve the materials already cited in connection with the filling of the casing formed by the fiber balls. But it may also consist of a material, such as peat, clay, vegetable powder, kaolin, almond bran, a cream or the like, contained in or between the fiber balls.

The process according to the invention for the preparation of aggregates of fiber balls consists of arranging an assembly of fiber balls prepared by the known processes of spherically entangled fibers and/or filaments in the desired shape and to join together said fiber balls.

Advantageously, the fiber balls are connected with each other by means of connecting fibers, preferably binder fibers activated after the shaping of the aggregate. Fiber balls containing binder fibers or separate binders inserted between the fiber balls may be used.

Melting fibers may be employed as binder fibers, wherein the fiber balls arranged in the desired shape are exposed to an elevated temperature, preferably at least to the melting temperature of the binder fibers.

Prior to placing the balls into a desired form, other materials may be inserted into the fiber balls. It is further possible to introduce other materials, in particular grainy materials, between the balls during the shaping of the fiber balls into the desired form. In addition or alternatively, other materials may be placed into or between the balls following the activation of the binder fibers.

While with fiber fleeces, for example, only certain flat configurations may be achieved, if no sections are to be cut off or from the fleece after the preparation of the fleece, the fiber balls may be placed into a desired form prior to the activation of the binder fibers. According to the novel process, fibers may also be produced in any spatial shape desired. Thus, molds may be filled with fiber balls, whereupon the binder fibers are activated and a spatial shape conforming to the mold may be taken from the mold,.

Filters may also be prepared, wherein corresponding to the shape of the filter mold, a layer of large fiber balls is laid down, upon which as the filter itself, smaller fiber balls or, for example, activated carbon, are placed as the filter materials, whereupon this second layer is again covered by larger fiber balls. In the process, a ring of fiber balls amy be placed at the edge of the filter layer itself, to prevent the lateral dropping out of the active carbon particles or the like. Such filters may take on any shape, without leaving waste, as in the case of filters made of fiber fleece.

Depending on the pressure applied to the fiber balls prior to the activation of the binder fibers, the density and thus the hardness of such aggregates may be adjusted.

In particular, fiber balls of different color, hardness , density and/or with different fibers may be mixed in such aggregates. Particularly by the additional application of heat to the outer zones of the aggregate, an outer layer may be created, in which essentially all fibers are intimately connected with each other, whereby a harder and denser shell of the aggregate is obtained, which optionally may be printed. It may thus be sufficient to bond together only the fiber balls located in the shell, whereby the fiber balls of the core are held together.

Due to the fact that by the process of the invention, not individual fibers, but fiber balls are bonded together, such an aggregate contains a large air component. The aggregate is thereby rendered highly elastic. The elasticity may be further increased by the use of fiber balls in which the individual fibers are bonded to each other, so that the balls used have a higher elasticity.

I claim:

1. A fiber aggregate, for a filler material for covers or pillows, a cushioning material, or filters, comprising a plurality of fiber balls bonded together by connecting binder fibers, wherein each fiber ball comprises fibers or filaments which are spherically entangled.

2. An aggregate according to claim 1 characterized in that the binder fibers are melting fibers having a melting point lower than the melting point of other fibers of the aggregate.

3. An aggregate according to the claim 1 characterized in that the binder fibers are thermoplastic fibers.

4. An aggregate according to claim 1, characterized in that the binder fibers are more rigid or coarser than the other fibers of the aggregate.

5. an aggregate according to claims 1, wherein the fiber balls have different diameters, different colors or different fibers.

6. An aggregate according to claim 1, wherein the individual fiber balls further comprise a grainy material.

7. An aggregate according to claim 1, further comprising a grainy material disposed between adjacent fiber balls.

8. An aggregate according to claim 1 wherein the binder fibers are present in the individual fiber balls.

9. An aggregate according to claim 1 wherein the binder fibers are present between the individual fiber balls.

* * * * *